United States Patent [19]

Murphy et al.

[11] 4,136,203

[45] Jan. 23, 1979

[54] MEAT PACKAGING

[75] Inventors: Robert E. Murphy, Downers Grove; Harry F. Bernholdt, Lombard, both of Ill.

[73] Assignee: Swift & Company, Chicago, Ill.

[21] Appl. No.: 835,421

[22] Filed: Sep. 21, 1977

Related U.S. Application Data

[63] Continuation-in-part of Ser. No. 703,593, Jul. 8, 1976, abandoned.

[51] Int. Cl.[2] ..... B65D 33/02

[52] U.S. Cl. ..... 426/124; 206/523; 426/129; 426/410; 229/55; 428/310; 428/315; 428/321

[58] Field of Search ..... 426/410, 412, 415, 393, 426/124, 129, 125, 127; 229/1.5 B, 55, 2.5 R; 206/523, 524, 217; 428/310, 311, 315, 321

[56] References Cited

U.S. PATENT DOCUMENTS

| | | | |
|---|---|---|---|
| 2,737,503 | 3/1956 | Sprague et al. | 229/2.5 |
| 2,891,870 | 6/1959 | Selby et al. | 426/124 |
| 3,026,209 | 3/1962 | Niblack et al. | 426/129 |
| 3,264,165 | 8/1966 | Stickel | 428/310 |
| 3,397,068 | 8/1968 | Schaefer et al. | 229/2.5 |
| 3,589,592 | 6/1971 | Tigner | 229/1.5 B |
| 3,606,136 | 9/1971 | Hegardt | 229/5.5 |
| 3,653,927 | 4/1972 | Howell et al. | 426/124 |
| 3,734,273 | 5/1973 | Watanabe | 206/523 |
| 3,983,258 | 9/1976 | Weaver | 426/129 |
| 4,029,822 | 6/1977 | Comer | 426/124 |

FOREIGN PATENT DOCUMENTS

| | | | |
|---|---|---|---|
| 837923 | 6/1960 | United Kingdom | 426/129 |

*Primary Examiner*—Steven L. Weinstein
*Attorney, Agent, or Firm*—Charles E. Bouton

[57] ABSTRACT

A layer of foamed material and an oxygen impervious surface covering are interposed between areas of a meat portion and a wrapper film where puncture is likely to occur.

17 Claims, 5 Drawing Figures

MEAT PACKAGING

This is a continuation-in-part of our prior copending application Ser. No. 703,593 filed July 8, 1976 and abandoned subsequent to the filing of this application.

The present invention is directed to a method and means for wrapping meat cuts, and more particularly relates to an improved method, cushioning article, and package to prevent the puncturing of a wrapper by sharp portions, such as bone parts, of a meat cut.

When animal carcass goods are prepared for shipment to market they are often subdivided into portions that may be individually wrapped for preservation and protection. Evacuation of air from the wrapper is advantageous as it extends storage life. Sometimes these portions are large "primal parts" weighing many pounds, and sometimes they are as small as consumer sized roasts and cuts. Most of the portions, however, regardless of size, are of irregular shape and most contain bones that are exposed at one or more surfaces of such portions. Hence, there are many relatively sharp protrusions on those portions.

Additionally the portions to be shipped must be handled extensively as they are stacked or boxed or hung and moved about at the packing plant, and then handled further at a warehouse, still further handled at the retail store; and during transport between those locations the portions are shaken and subjected to much abuse.

Thus, it will be apparent that both the configuration of the meat portions and the necessary handling of same promote the puncturing of any wrapper material both from within by relatively sharp bones or other parts of the meat item and from exterior forces applied against such bones and parts. As briefly mentioned the wrapper is often necessary for preservation of the meat and the particular wrapper material is usually selected for that purpose. Vacuum packaging within an oxygen impervious wrapper is a further means of preservation. However, the evacuation of the wrapper will cause it to closely conform to the surface shape of a meat portion, and thereby tend to increase the likelihood of puncture by sharp bone and the like.

The wrapper material itself may be strengthened to a degree to resist puncture. However, this would normally entail a modification in thickness or content uniformly throughout the film which is relatively expensive and actually unnecessary in view of the fact that the areas most likely to be punctured are relatively limited. Moreover, a wax impregnated non-absorptive fabric has been available to use between the wrapper and meat at puncture prone areas, such as at bone ends. (See U.S. Pat. Nos. 2,891,870 and 3,653,927.) And microcrystalline wax has been applied directly to bone ends (see U.S. Pat. No. 3,983,258). These materials are relatively expensive.

Transparent oxygen impervious plastic film is the most popular wrapping material as it allows customer inspection of the product without opening the package. However, this type of film, while excellent for many purposes such as preservation of meat color, also makes visible both the exposed bone ends and the liquids that normally are released from the cut meat surfaces and which tend to collect in pockets between the film and meat. The latter are considered unattractive. Also the prior art wax impregnated fabric, when used, is not attractive.

Further, it has been found that the prior protective means have not been highly efficient in eliminating "leakers" among evacuated packages, and such prior art practices have been subject to an unsatisfactory rate of defective packages. A possible reason for this is that the aforesaid prior protective materials, while being highly conformable to the product surface shape, have not been resilient or elastic in the sense of an ability to recover the original shape once the protective material has been deformed. (This property will hereinafter be referred to as "resiliency".) Thus, the cushioning and protective property of those materials appears to be diminished with each application of force against same from either the interior or exterior of a package.

Accordingly, there is a need for a resilient, less expensive, more efficient and more attractive means to resist puncture. Moreover, for many applications it is desirable that such means be capable of being conformed to the product shape, and capable of either absorbing or adsorbing liquids. It would be highly advantageous if several of those advantages could be combined in a single medium. To this end a thin resilient foam cushion was tested. However, it was found that even in a vacuum package the tiny cells of the foam apparently retained enough air to cause a subsequent discoloration on the meat surface that was directly contacted by the foam material. That is, residual oxygen from the foam cells was sufficient to convert the meat pigments at the contacted meat surface to an unattractive and unacceptable (consumer-wise) brown metamyoglobin. When the meat was unwrapped for further subdivision and/or sale it was found to have unsightly brown areas where the foam cushioning material was placed.

Thus, it is a principle object of the present invention to provide an improved method, an improved article of manufacture and an improved package for packaging meat items having sharp bone ends, and the like, whereby a relatively inexpensive resilient means is provided to protect a wrapper against puncture.

It is another object of the present invention to provide an improved method, an improved article of manufacture and an improved package for packaging meat items having sharp bone ends, and the like, whereby a wrapper will be repeatedly protected against puncture by successive forces applied against the wrapper in the area of the bone ends and the like.

Yet another object of the present invention is to provide an improved method, article of manufacture, and package for protecting a meat package wrapper against puncture wherein a protective layer interposed between the meat and wrapper is both resilient and conformable to the meat surface.

Basically, the present invention comprises the interposition of a thin layer of resilient foam material between the wrapper film and the meat portion at a site of potential puncture with a surface covering of oxygen impervious material placed directly between the foam and the meat surface. The presence of the last mentioned surface covering prevents oxygen from the foam reacting with pigments at the meat surface. In many applications the foam will also remain accessible to any free liquids that may be retained between the wrapper and the meat surface.

Further objects and advantages will become apparent upon reading the following detailed description of the invention in conjunction with the drawings wherein.

Figure 2:
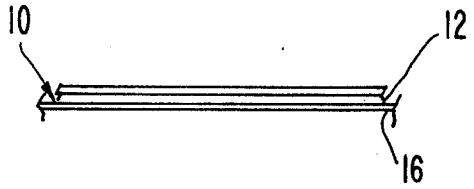
FIG. 2 is an end view of an article of manufacture comprising a thin layer of foam and a layer of oxyen impervious material useful in the present invention.

The present invention is applicable to the meat industry, particularly at the packinghouse level. It is of greatest advantage when applied to relatively large unitary pieces of meat containing bone structure, such as so-called primal cuts. However, it is also applicable and of advantage with respect to smaller portions and even consumer size cuts such as roasts and steaks, etc.

The invention comprises the use of a special cushion film structure generally 10, combining a resilient foam layer and an oxygen impermeable surface covering, at meat surface areas that are likely to contribute to the puncturing of a film wrapper. A resilient plastic foam material is preferred such as polyethylene, polypropylene, ethyl cellulose, urethane and vinyl, although foamed cellulose materials are often effective. These foams comprise a network matrix of the solid material encompassing a uniform abundance of micropores or cells of approximately 1.0 to 1.5 mm. average diameter.

A number of such foam materials are available commercially in sheet and roll form. For the purpose of the present invention it must be non-toxic and of food grade quality and free of any objectionable amounts of constituent materials that might migrate to the meat product.

The foam material should also be sufficiently flexible so as to be capable of being closely shaped and formed to the meat surface. Resilient foam materials, however, will not normally conform to the shape of the meat surface as they tend to return to original shape when released. This property may make it difficult to keep the foam layer in proper position while the outer wrapper is applied to the meat item. Accordingly, in many applications of the present invention it is also preferred to include some means to cause the foam layer to remain substantially conformed to the meat surface shape for at least a reasonable time sufficient to apply the outer wrapper.

It is also preferred that the foam be of a closed cell structure rather than an open cell structure, particularly where the resultant package is to be evacuated, as open cell structures tend to collapse and lose cushioning effect or resiliency when subjected to vacuum conditions. However, this feature will usually be found to be accomplished by a lesser absorptive or adsorptive capacity as the interior of the cells will not be available to receive liquids.

Thus, it will be understood that the choice of resilient foam material will be a compromise to obtain a combination of features and advantages required for a particular package embodiment, and not all advantages may be available in a given application. Indeed, each of the features of (1) absence of oxygen availability, (2) conformability and (3) liquid absorptive/adsorptive capacity, are usually less available with foams of relatively greater resiliency. However, the paramount features which must be obtained at the meat surface in all embodiments of the present invention are resiliency and absence of oxygen availability.

A suitable cushion film generally 10 is shown in FIG. 2 wherein a composite sheet consisting of one or more resilient foam layers 12 united together and bonded to a barrier film 16 surface covering. A single foam layer is sufficient where it is of a dimension sufficient to enfold the puncture prone structures. It has been found that a total foam layer thickness of approximately 1/16–⅛ inch is adequate for most packinghouse applications. The particular thickness will largely depend on the composition of the foam and size and type of cells and whether the package is to be evacuated.

The barrier film 16 must be sufficiently oxygen impermeable to avoid deleterious migration of oxygen from the foam to the meat surface. An oxygen transfer rate of 2.00 cc/100 sq. inches/24 hours should not be exceeded. Suitable barrier films 16 may be composed of polyvinylidine chloride, polyvinyl alcohol, aluminum foil, styrene acrylic copolymers, styrene acrylic nitrite copolymers, acrylic multi-polymers. These materials may be used as individual films or as laminates of two or more or in combination with other known wrapping materials such as polyesters, polyethylene, polypropylene, and even paper.

Incorporation of a metal foil, such as aluminum foil, in the barrier film structure, either alone or laminated with another film, is one means for obtaining a "dead fold" quality which will enable the cushion film generally 10 to be conformed to the shape of the meat surface and to hold that shape while being over-wrapped.

The barrier film 16 should also be non-toxic and of food grade quality and free of objectionable constituents. Barrier films 16 of approximately 70 gauge (0.0007 inch) thickness have been found satisfactory. Such films 16 may be used entirely separate from the foam layer 12; however, it is preferred to bond the barrier film 16 to the foam layer 12 by a suitable adhesive (non-toxic, food grade, etc.) or by directly heat sealing the two together or by coating one material on the other. Any manner of joining the materials is satisfactory. The bonded composite cushion film generally 10 is believed to provide greater resistance to penetration than the use of separate unjoined layers.

It should also be noted that for best results the barrier film 10 should extend slightly beyond the edges of the foam layer 12, otherwise there is a tendency for oxygen to migrate from the edge of the foam to the meat surface. However, if small areas of discoloration are not objectionable the overlap is not critical.

A further foam cushion may be formed in a unitary manner where the foam is itself made of a substantially oxygen impermeable material, in which case one surface and the edges of the foam may be treated, as by heat, to seal the cellular structure into a continuous surface covering that is impermeable to oxygen.

Figure 1:
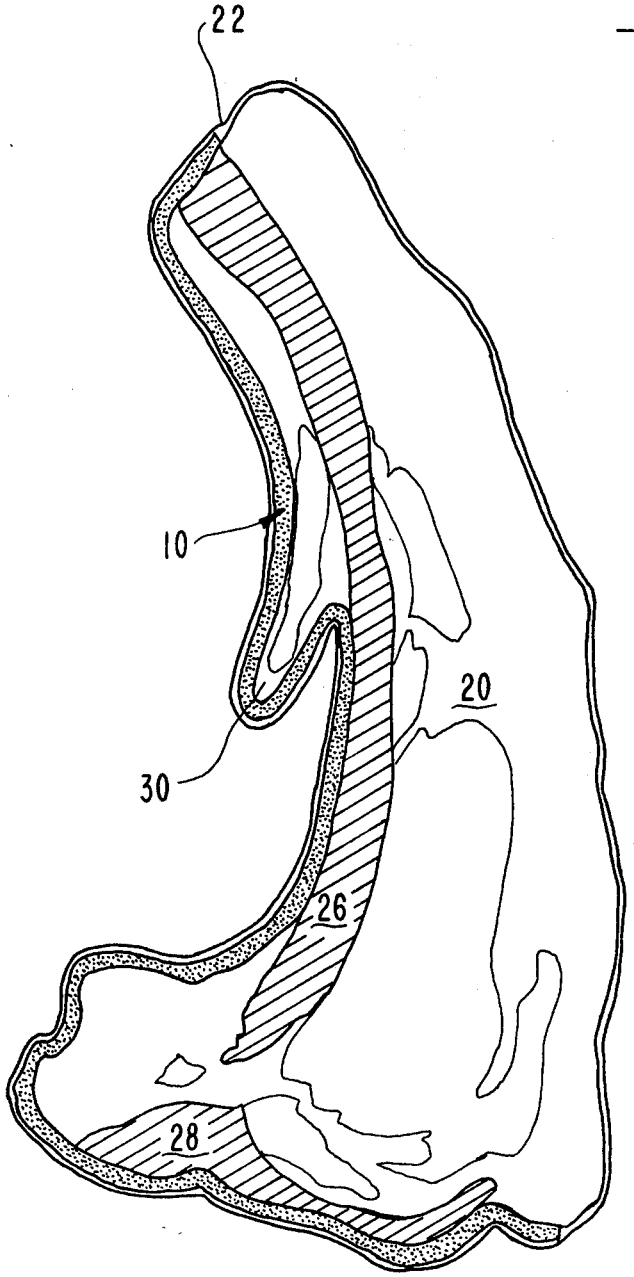
FIG. 1 is a section view of a meat package incorporating the present invention in which the bone parts are crosshatched.

As may be seen in FIG. 1 the cushion film 10 is laid directly against only those surfaces of a meat item 20 that would potentially puncture a wrapper film 22 that completely encloses the item. In the illustrations the meat item 20 is a rib portion sufficient for one or more steaks. This portion contains rib and vertebra bones 26, 28 respectively, and further presents a very irregular and sharp surface containing a diaphragm portion 30, all of which may potentially puncture the wrapper 22. In this instance a rather generous quantity of cushion film 10 has been applied in web form to cover all of the aforementioned parts. The remaining surfaces are visible to the consumer where the wrapper 22 is a transparent material such as Nylon-Surlyn coextrusion (Surlyn is a trademark identifying a cross linked esterified polyethylene material, and Nylon is a trademark identifying a polyamide material).

Figure 3:
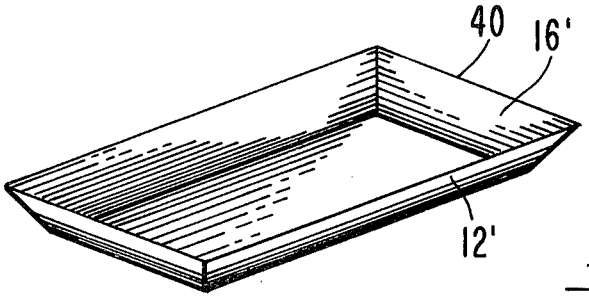
FIG. 3 is a perspective view of a tray manufactured to be used in another embodiment of the present invention.
Figure 4:
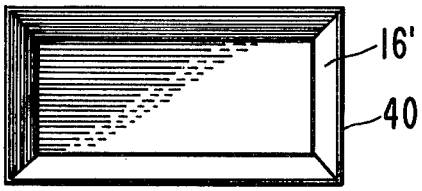
FIG. 4 is a plan view of the tray of FIG. 3.

Another manner of application of the aforedescribed cushion film generally 10 is to preform trays 40 of the composite materials with the barrier film 16 applied across the inner or concave tray surface. Such preformed trays 40 may be made in various shapes and sizes to fit the particular meat cuts being processed. Rectangular trays as illustrated in FIGS. 3 and 4 (wherein parts corresponding to those previously described bear the same reference number with a prime (') notation) measuring about eighteen inches long, by about nine to sixteen inches wide and three inches deep, were found to be applicable to a wide variety of meat cuts. However, such trays have the disadvantage of being difficult to maintain in proper positions while applying the outer wrapper 22 to the product.

Figure 5:
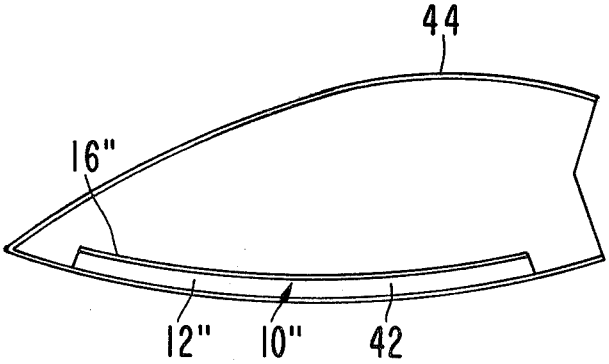
FIG. 5 is a sectional view of a pouch containing the present invention.

A better manner of application of the aforedescribed cushion film generally 10 is to secure a web 42 of such material to at least one inside surface of an outer film wrapper pouch 44 as shown in FIG. 5 (wherein corresponding parts bear the same reference character with a double prime (") notation). In this embodiment the pouches are of sizes adequate to envelope the meat portions to be wrapped. Most meat cuts do not have bone exposed on all surfaces, and therefore it will usually be sufficient to apply the cushion film 10" to only one inner surface of the pouch. Preferably both the pouch 44 film and the foam layer 12" are made of thermal bonding materials, such as polyethylene, to facilitate the joining operations. In this application, however, the foam material will be less available to absorb/adsorb any free liquids.

Also where the cushion film 10 is applied as a web directly to the meat item surface, it may be preferred that the foam layer 12 be a material that is itself thermo bondable to the inner surface of the outer wrapper. Again this is facilitated with polyethylene foam. The advantage in this is achieved where the outer wrapper is then subjected to a heat treatment, such as by a heat shrink tunnel, with the result that the foam layer 12 becomes bonded directly thereto. This also will result in the foam material becoming less available to absorb/adsorb any free liquids after the heat treatment. Ultimately when the package is opened and the meat removed the cushion layer 12 and barrier film 16 will be separated from the meat surfaces along with the outer wrapper.

A most preferred feature of the present invention is to coat at least one surface of the cushion film 10, and preferably the meat contacting surface of the barrier film, with a non-toxic, food grade, United States Department of Agriculture approved adhesive. Several adhesives may be suitable. However, it has been found that a water based adhesive works best. The advantage is that the cushion film 10 will be adhered to itself at points where it is folded or overlapped upon itself and thus tend to better conform and hold to the shape of the protected surface. This technique is particularly useful where the foam layer is highly resilient. A particularly effective water based adhesive meeting the above stated qualifications is produced and sold by the Major Chemical & Latex Corporation (31-39 Allerton Street) of Boston, Mass. under the trade identification "Formula E-3000M." Formula E-3000M is comprised of about 98% natural latex modified with small amounts of silicone anti foam agent, stabilizers and emulsifying agents.

Preferably the entire package is subjected to vacuum, in any manner known to the art, to remove air from between the wrapper 22 and the meat 20. This step will cause the wrapper 22 to be urged closely against all of the meat surfaces and thereby tightly conform the cushion film 10 to the protected surface.

EXAMPLES

I. Early work to devise a superior package puncture inhibitor attempted to utilize ⅛ inch thick layers of polypropylene foam material (without any barrier film) placed between the bone surfaces of a meat item and a plastic film wrapper (in this instance Cry-O-Vac (a trademark identifying a polyethylene/-polyvinylidene/EVA polyethylene) film of 0.003–0.005 inch thickness). Several beef rib cuts (roasts) were placed in Cry-O-Vac bags and evacuated and sealed. About half of the packages included the aforementioned layers of foam material across the exposed bone surfaces. Those packages not containing the foam layers were regarded as controls. All packages were shipped several hundred miles from a production facility to a laboratory. Upon receipt the packages were inspected for leaks and for color appearance. The latter was estimated on a scale of 1 through 9 with best color being awarded a higher number.

Two control packages were observed to be leakers. The meat in those packages had become discolored and was given a rating of 6 on the basis of an estimate of 50% metmayoglobin and 50% oxymyoglobin colors. The remaining control packages had good color. None of the test packages with foam layers were leakers. Observations of the latter indicated that the meat surfaces not covered by foam had a color rating of 9 and appeared to be 100% oxymyoglobin. However, it was found, upon removing the wrapper and foam layer that both the meat and bone surfaces that had been covered by the foam were very discolored and were rated at 5 because of a preponderance of metmayoglobin.

The foregoing example demonstrated that a foam material alone was not acceptable as a protection against puncture because of the unacceptable effect on product color.

II. Comparison tests were run to evaluate the incidence of leaker packages as between packaging techniques utilizing the present invention and substantially the inventions disclosed in U.S. Pat. Nos. 2,891,870 and 3,983,258. These tests were conducted over a period of about eight successive calendar days during which time packages were prepared and evacuated at a meat packing plant in Texas and shipped in corrugated containers to a controlled facility in Miami, Florida where they were examined. Six combinations of outer wrapper film and bone puncture protector were tested. Each combination was used to make forty-eight packages of beef rib cuts weighing approximately 18 to 25 lbs. each. The following package combinations were used:

A. (Substantially according to U.S. Pat. No. 3,983,258.) Conofresh brand wrapper film about 0.033–0.005 inches thick comprising outer lamina of Nylon and ethyl vinyl acetate copolymer with polythylene bonded together with a layer of a homo-polymer of polyethylene, supplied by the Continental Can Company, Inc., applied over bone end applications of microcrystalline wax.

B. (Substantially according to U.S. Pat. No. 3,983,258.) An outerwrapper film comprising a laminate of 1 mil Nylon and 3 mil Surlyn supplied by the St. Regis Paper Company, applied over bone end applications of micro-crystalline wax.

C. (Substantially according to U.S. Pat. No. 2,891,870) The Conofresh film, as per Example II A, was applied over wax impregnated cheesecloth placed on the bone end areas of the meat cuts.

D. (Substantially according to U.S. Pat. No. 2,891,870.) The film supplied by the St. Regis Paper Company, per Example II B, was applied over wax impregnated cheesecloth placed on the bone end areas of the meat cuts.

E. (Present invention) The Conofresh film of Examples II A and C was applied over trays fabricated according to the present invention from a 1/16 inch thick layer of polypropylene foam and a barrier film of 1 mil thick Saran (polyvinylidene chloride) bonded thereto. The trays measured eighteen by twelve inches and were three inches deep and were placed over the exposed bone areas of the meat items.

F. (Present invention) The trays of Example II E were utilized with the St. Regis film of Examples II B and D. Inspection after shipment revealed the following:

| | Good Packages | Minor Leakers | Major Leakers |
|---|---|---|---|
| A | 44% | 14% | 42% |
| B | 49 | 28 | 23 |
| C | 52 | 13 | 35 |
| D | 56 | 11 | 33 |
| E | 96 | 4 | 0 |
| F | 73 | 21 | 6 |

III. Equal numbers of beef chunk portions (both arm and blade cuts) weighing approximately 35–40 lbs., were packaged according to the present invention and as controls using wax impregnated cloth, in Conofresh brand film wrappers, evacuated, boxed, and shipped from Texas to a store in Massachusetts for comparison. Those portions packaged according to the present invention utilized a resilient web of 3/16 inch polyethylene foam covered on one surface with 50 gage Saran film (Dow Chemical Co.) and the outer surface of the Saran film was coated with adhesive E-3000M (Major Chemical & Latex Corp.). The web foam was applied to the bone surfaces, with the adhesive coating against the meat item and was shaped by hand to conform with the surface shape.

Upon inspection at the delivery point for leakers the following was observed:

| Package | Not Leak | Major Leak | Minor Leak |
|---|---|---|---|
| Control-Chuck Arm Portion | 47% | 32% | 21% |
| Control-Chuck Blade Portion | 30% | 61% | 9% |
| Foam & Saran-Chuck Arm Portion | 68% | 10% | 22% |
| Foam & Saran-Chuck Blade Portion | 66% | 12% | 22% |

Obviously any modifications and variations of the invention as hereinbefore set forth may be made without departing from the spirit and scope thereof, and therefore, only such limitations should be imposed as are indicated in the appended claims.

We claim:

1. An improved meat package, said package comprising: a meat item encased in a wrapper, said meat item having surface area potentially capable of puncturing said wrapper; and a cushion film interposed between said surface areas and said wrapper, said cushion film comprising a layer of flexible and resilient foam material and an oxygen impermeable surface covering disposed between said layer and said surface areas.

2. The package of claim 1 wherein said cushion film includes a layer of foam about 1/16–⅛ inch thick.

3. The package of claim 1 wherein said cushion film includes a surface covering that is a separate film that is bonded to a surface of said foam material.

4. The package of claim 1 wherein the resilient foam material is capable of absorbing or adsorbing at least a quantity of liquid that may be released from said meat portion.

5. The package of claim 1 wherein the package is evacuated and said oxygen impermeable surface covering prevents oxygen in said foam material from contacting the meat surface areas covered thereby.

6. The package of claim 1 wherein said cushion film includes an oxygen impervious foam material and said surface covering is a continuous film of the same material.

7. The package of claim 1 wherein said cushion film has a surface covering that extends beyond the edges of said foam layer.

8. The package of claim 1 wherein at least one surface of said cushion film is coated with a non-toxic adhesive.

9. The package of claim 8 wherein the non-toxic adhesive is coated on the meat contacting surface of said surface covering.

10. An improved meat package, said package comprising: a meat item completely encased in a wrapper, said meat item having surface areas potentially capable of puncturing said wrapper; and a cushion film in contact with and interposed between said surface areas and said wrapper, said cushion film comprising a layer of a flexible and resilient liquid absorptive or adsorptive foam material and an oxygen impermeable surface covering disposed between said layer and said surface areas said layer of a foam material being accessible to any free liquid that may be retained between said wrapper and said meat surface.

11. An improved method of packaging meat items so as to prevent the puncturing of a wrapper, said method comprising: placing a cushion film across surface areas of a meat item that could potentially puncture a wrapper, said cushion film comprising a layer of a flexible and resilient foam material and an oxygen impermeable surface covering disposed between said foam and said surface areas; and enwrapping said meat, item and said cushion film with a wrapper.

12. The method of claim 11 wherein the resilient foam material is capable of absorbing or adsorbing at least a quantity of liquid may be released from said meat item.

13. The method of claim 11 wherein the space between said wrapper and said meat items is evacuated.

14. The method of claim 13 wherein said oxygen impermeable surface covering prevents oxygen in said foam material from contacting the meat surface areas covered thereby.

15. The method of claim 11 wherein at lease one surface of said cushion film is coated with a non-toxic adhesive, and said cushion film and surface covering are folded and overlapped to conform closely with the meat surface areas to be protected against wrapper puncture whereby said adhesive coated portions of said cushion film will adhere together so as to hold said cushion film against the contours of said meat surface areas during said enwrapping step.

16. The method of claim 15 wherein said non-toxic adhesive is coated on the meat contacting surface of said surface covering.

17. An improved method for packaging meat items so as to prevent the puncturing of a wrapper, said method comprising: placing a cushion film across surface areas of a meat item that could potentially puncture a wrapper, said cushion film comprising a layer of flexible and resilient liquid absorptive or adsorptive foam material and an oxygen impermeable surface covering disposed between said foam and said surface areas, said layer of foam material being accessible to any free liquid that may be retained between said wrapper and said meat surface, and completely enwrapping said meat items and said cushion film with a wrapper.

* * * * *